US009260816B2

(12) United States Patent
Lander

(10) Patent No.: US 9,260,816 B2
(45) Date of Patent: Feb. 16, 2016

(54) HINGE ARRANGEMENT FOR A GARMENT WASHING DEVICE

(75) Inventor: Jack R. Lander, Southbury, CT (US)

(73) Assignee: Phantastic Innovations, Inc., Houston, TX (US)

( * ) Notice: Subject to any disclaimer, the term of this patent is extended or adjusted under 35 U.S.C. 154(b) by 1047 days.

(21) Appl. No.: 13/281,035

(22) Filed: Oct. 25, 2011

(65) Prior Publication Data

US 2013/0098120 A1 Apr. 25, 2013

(51) Int. Cl.
*D06F 95/00* (2006.01)

(52) U.S. Cl.
CPC ..... *D06F 95/008* (2013.01)

(58) Field of Classification Search
CPC ..... D06F 95/006; D06F 59/02; D06F 95/008; D06F 1/12; D06F 39/00; D06F 53/02; D06F 58/04; D06F 58/20
USPC ..... 223/84, 66, 85, 1, 91; 68/237, 23 R; 206/278, 292, 469, 515
See application file for complete search history.

(56) References Cited

U.S. PATENT DOCUMENTS 3,965,533 A * 6/1976 Frohlich ..... 16/300
5,829,083 A 11/1998 Sutton
5,971,236 A 10/1999 DesForges et al.
6,234,368 B1 5/2001 DesForges et al.
6,510,972 B1 1/2003 Briskey
6,742,683 B1 6/2004 Phan
7,350,679 B2 4/2008 Radtke et al.
8,109,417 B2 2/2012 Phan
2006/0162397 A1 7/2006 Ke
2009/0185764 A1 7/2009 Hsieh

OTHER PUBLICATIONS

International Search Report and Written Opinion of the International Searching Authority, dated Jan. 8, 2013.

* cited by examiner

*Primary Examiner* — David Cormier
*Assistant Examiner* — Irina Graf
(74) *Attorney, Agent, or Firm* — Cook Alex Ltd.

(57) ABSTRACT

A bra-washing device includes a shell with an interior, the shell includes two shell portions, each with a rim. A latch holds the two shell portions closed and the latch may be opened to access the interior of the shell. A hinge pivotally couples the two shell portions to each other. The hinge includes at least one hinge knuckle extending from the rim of each shell portion, the hinge knuckles of the two shell portions in axial alignment, an internal bore extending into the hinge knuckles on each shell portion, a hinge pin inserted into the internal bore of the hinge knuckles, and a fastener extending at least partially through the internal bore near one end of the hinge pin to block the hinge pin from sliding out of the internal bore.

18 Claims, 12 Drawing Sheets

HINGE ARRANGEMENT FOR A GARMENT WASHING DEVICE

FIELD OF THE INVENTION

The present invention generally relates to devices for washing clothes. In particular, embodiments relate to a hinge arrangement for devices for washing brassieres.

BACKGROUND OF THE INVENTION

Brassieres are commonly made with two cups, two shoulder straps, two back straps, a latching mechanism (hooks and eyelets), optional padding (soft foam, air, water, gel, or silicone), and, optionally, two underwires. Padding can come as removable inserts or as an integral part of the bra. Some bras comprise extremely delicate fabric, such as lace, satin, silk, mesh, high-tech microfiber, stretch, and sheer fabric.

Thus, it is desirable to have a device which provides protection for the bra during a washing cycle in a conventional clothes washing machine. Preferably, the washing device also assists in maintaining the overall shape of the bra during a washing cycle. The washing device also preferably prevents any underwire from puncturing through the fabric of the bra and ruining the bra. One such bra washing device is shown in U.S. Pat. No. 6,742,683. The washing device of this patent consists of an outer shell with two shell portions which are hinged together along one side of the shell portions and which have a latch along an opposite side of the shell portions. The shell can thus be opened to insert a bra to be washed, and then the shell can be latched in a closed condition prior to placing the washing device in the washing machine. When washing is completed, the shell can be opened via the latch to remove the washed bra.

The hinge structure of such a bra washing device includes knuckles or projections which extend outwardly along a portion of the mating edge of each shell portion. These knuckles have a small internal bore into which a metal hinge pin is inserted during manufacture of the device. Normally, a frictional fit between the internal bore and the hinge pin will keep the hinge pin in place in the internal bore. However, when the washing device is inserted into a washing machine, the water and detergent in the washing machine reduce the friction between the hinge pin and the internal hinge bore. Also, the pounding of he device by the agitator of the washing machine can dislodge the hinge pin and cause it to migrate out of the bore. Thus, the hinge pin may begin to slide partially or entirely out of the internal hinge bore. Of course, if the hinge pin is partially out of the hinge bore, it may catch or snag on other clothes with the potential to damage or ruin the clothes. On the other hand, if the hinge pin comes entirely out of the bore, the washing device may open far enough to discharge the bra out of the device during the wash cycle. If the hinge pin slides out of the internal hinge bore, damage could also result to the washing device, particularly around the latch of the device.

Various means have been tried to prevent the hinge pin from migrating out of the internal bore in the plastic hinge. For example, a raised knurl at the entrance to the internal bore may keep the hinge pin in place due to the greater friction against the hinge pin. However, manufacturing tolerances of the knurl and of the internal bore may cause excessive stress in the plastic material of the hinge, which may cause the plastic to crack at a later time. The cracked hinge may be unsightly, may cause damage to other clothing in the washing machine, and/or may nevertheless cause a reduction of friction with the hinge pin and permit the hinge pin to migrate out of the internal bore. Thus, knurling of the plastic material is not a satisfactory solution to keeping the hinge pin in its internal bore.

Heretofore, heat staking attempts were made to fill an end of the hinge pin bore to prevent or block the hinge pin from sliding out of the bore. For example, a similar or compatible plastic material to that of the washing device was melted about and into an end of the bore with a heat source, such as a soldering iron. Frequently, the plastic filling material did not properly adhere to the plastic about the end of the hinge pin bore. In other instances, the agitation which a bra washing device experiences in a washing machine caused the fusing of the plastic materials to fail. Thus, fusing of the plastic materials around the entrance to the internal bore has also proven to be an unsatisfactory solution to retaining the hinge pin in its bore.

Moreover, after melting plastic about the hinge pin bore to block the hinge pin from sliding out, the melted plastic was typically irregular, requiring further finishing of the appearance of the melted plastic. For example, sanding or grinding was frequently required to provide a presentable final product, and to remove any rough edges of the melted plastic which could damage other clothes in the washing machine. This manual melting and finishing work was time consuming, and, therefore, an expensive portion of the overall manufacturing cost of the washing device.

It is therefore an object of the present invention to prevent a hinge pin from migrating out of the internal bore of a hinge, especially in a washing device.

Another object of the present invention is to provide a method of retaining a hinge pin in an internal bore of a hinge which is easy to teach and easy to accomplish, even by relatively unskilled production workers.

A further object of the present invention is to reduce the time and cost of manufacturing a bra washing device, thereby enabling greater efficiencies and higher volumes of manufactured product.

Yet another object of the present invention is to provide a simpler method of retaining the hinge pin in the hinge of a washing device which facilitates outside sourcing of the manufacture of the washing device.

SUMMARY OF THE INVENTION

Various embodiments of garment-washing devices are disclosed. In an embodiment, a bra-washing device includes a shell having an interior, the shell including two shell portions, each shell portion having a rim, and a latch which holds the two shell portions closed when the latch is closed and the shell portions may be opened by releasing the latch to access the interior of the shell.

In an embodiment, a hinge pivotally couples the two shell portions to each other. The hinge includes at least one hinge knuckle extending from the rim of each shell portion, the hinge knuckles of the two shell portions are in axial alignment, and an internal bore extends into the hinge knuckles on each shell portion.

In an embodiment, a hinge pin is inserted into the internal bore of the hinge knuckles, and a fastener intersects at least a part of the internal bore near one end of the hinge pin to block the hinge pin from sliding out of the internal bore. Preferably, the internal bore extends only partially into one of the hinge knuckles at one side of the hinge, and the hinge pin has a tapered end to facilitate insertion of the hinge pin into the internal bore.

In an embodiment, an aperture is preferably defined in an end knuckle of the hinge such that the aperture intersects with the internal bore, and the fastener is inserted into the hole to retain the hinge pin in the internal bore. The fastener may comprise an eyelet or a rivet.

BRIEF DESCRIPTION OF THE DRAWINGS

A better understanding of the present invention may be obtained when the following detailed description of preferred embodiments is considered in conjunction with the following drawings, in which.

Figure 1:
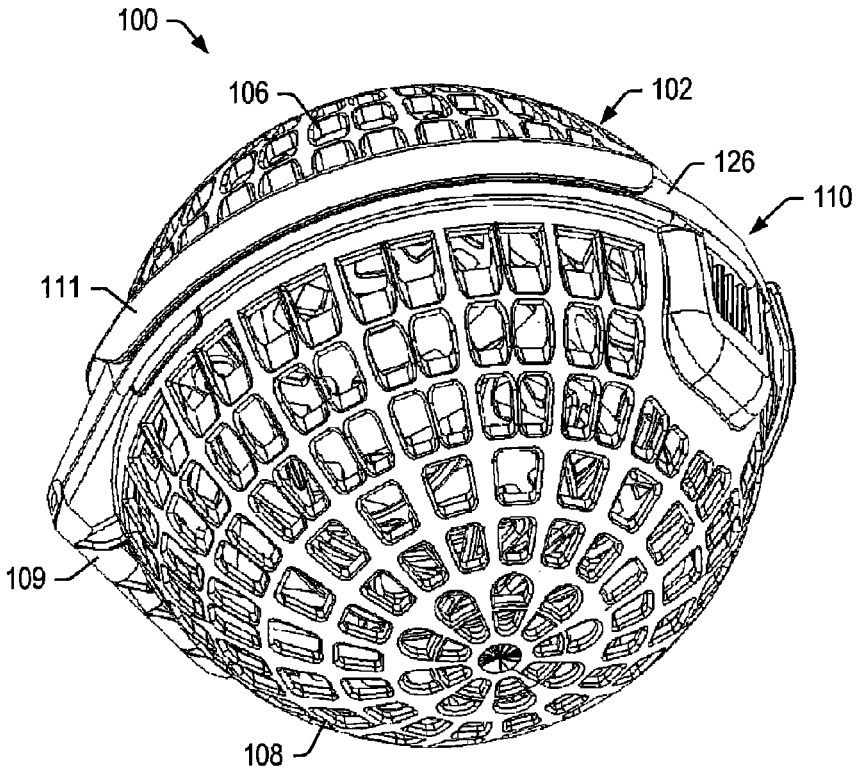
FIG. 1 is an external view of a washing device according to one embodiment.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended requests. Note that the headings are for organizational purposes only and are not meant to be used to limit or interpret the description or claims. Furthermore, note that the word "may" is used throughout this application in a permissive sense (i.e., having the potential to, being able to), not a mandatory sense (i.e., must). The term "include", and derivations thereof, mean "including, but not limited to". The term "coupled" means directly or indirectly coupled.

DESCRIPTION OF THE PREFERRED EMBODIMENTS

It will be understood that the present invention may be embodied in other specific forms without departing from the spirit thereof. The present examples and embodiments, therefore, are to be considered in all respects as illustrative and not restrictive, and the invention is not to be limited to the details presented herein.

Figure 2A:
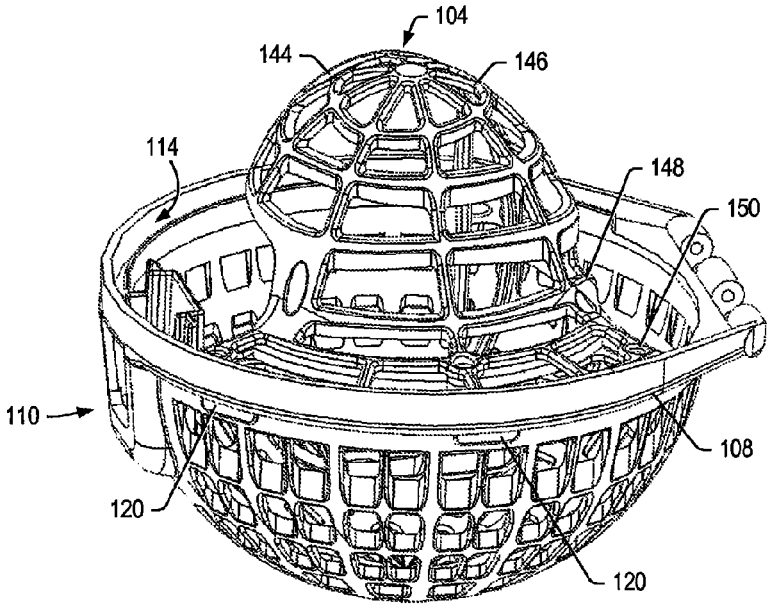
FIG. 2A illustrates a washing device with an insert according to one embodiment.
Figure 2B:
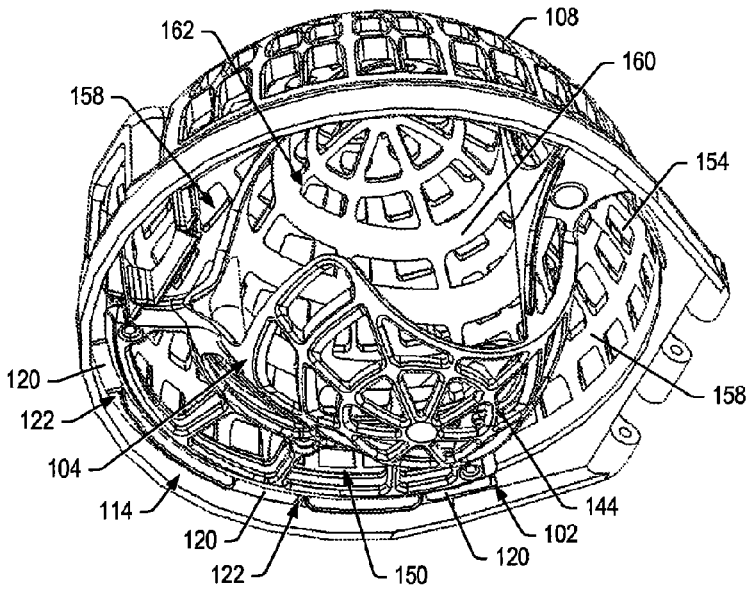
FIG. 2B is a different view of the washing device illustrated in FIG. 2A.

FIGS. 1, 2A, and 2B illustrate a washing device according to one embodiment. Washing device 100 includes shell 102 and insert 104. Shell 102 includes upper shell half 106 and lower shell half 108. Upper shell half 106 and lower shell half 108 may be pivotally connected at hinge 109. Shell 102 may be opened by swinging upper shell half 106 away from lower shell half 108. Insert 104 may be removed from shell 102 when shell 102 is open. Shell 102 includes latch mechanism 110. Latch mechanism 110 may hold shell 102 in a closed position.

Device 100 may protect a garment from damage caused by the washer, dryer, or other clothing articles. Device 100 may protect bra underwires from becoming bent or protruding from the bra and thus piercing its fabric. In one embodiment, shell 102 and insert 104 are made out of polypropylene that is heat graded to protect it from heat damage.

Figure 1A:
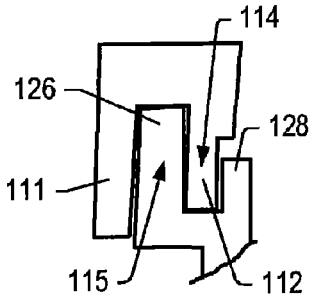
FIG. 1A is a cross sectional view of a junction between two halves of a shell of a washing device according to one embodiment.

As shown in FIGS. 1 and 1A, shell upper half 106 includes channel 115 between outer rim 111 and inner rim 112. Shell lower half 108 includes channel 114 between inner rim 128 and outer rim 126. Inner rim 112 of upper shell half 106 may nestle in channel 114 of lower shell half 108 when shell 102 is closed. Outer rim 126 of lower shell half 108 may nestle in channel 115 of upper shell half 106 when shell 102 is closed. Engagement of inner rim 112 in channel 114 and/or rim 126 in channel 115 may inhibit lateral movement of upper shell half 106 relative to lower shell half 108. Engagement of inner rim 112 in channel 114 and/or outer rim 126 in channel 115 may also inhibit deformation of the shell halves (e.g., flexure, buckling) near the junction of the upper shell half and the lower shell half. Inhibiting deformation may keep upper shell half 106 and lower shell half 108 from separating when external loads are encountered during washing and/or handling of device 100. Engagement of inner rim 112 in channel 114 and/or outer rim 126 in channel 115 may also alleviate stress on latch mechanism 110 and hinge 109.

Referring to FIGS. 2A and 2B, insert 104 includes tabs 120 (upper shell half 106 is not shown in FIG. 2A or 2B for clarity). Lower shell half 108 includes slots 122. Insert 104 may be coupled with lower shell half 108 by inserting each of tabs 120 on insert 104 in a corresponding slot 122 on lower shell half 108. Tabs 120 of insert 104 and slots 122 of lower shell half 108 may be distributed at various points along the circumference of lower shell half 108. At least one tab on an insert may be partially (as shown in FIG. 2A) or fully opposed to one or more other tabs on the insert.

Figure 3:
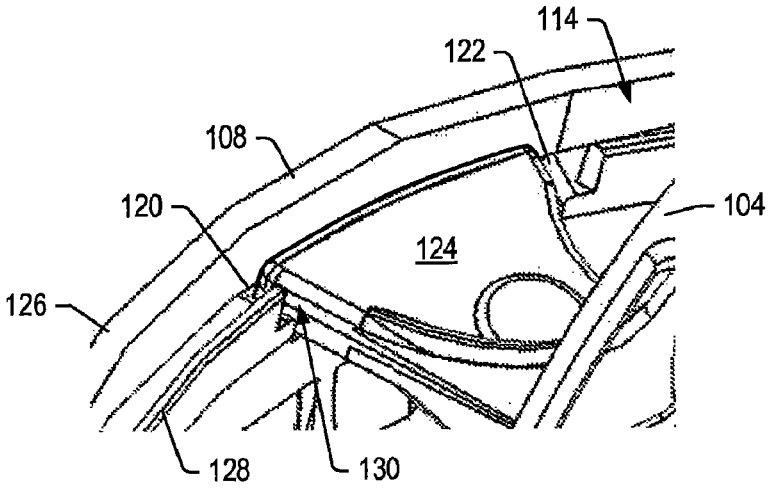
FIG. 3 is a detail view of a tab-slot connection between an insert and a shell of a washing device.

FIG. 3 is a detail view of one tab-slot connection between insert 104 and shell 102. Insert 104 includes arm 124. Lower shell half 108 includes outer rim 126 and inner rim 128. Outer rim 126 and inner rim 128 define channel 114 in lower shell half 108. Lower shell half 108 includes slot 122 at the bottom of channel 114. Arm 124 includes tab 120. Tab 120 may be inserted in slot 122 on lower shell half 108. Arm 124 may come to rest within break 130 in inner rim 128. When shell 102 is closed, inner rim 112 of upper shell half 106 (shown in FIG. 1) may hold arm 124 in place on lower shell half 106. In an similar manner, inner rim 112 of upper shell half 106 may hold other tabs 120 of insert 104 in place in slots 122 of lower shell half 108. Thus, closure of shell 102 may keep insert 104 in a relatively fixed position relative to shell 102.

In some embodiments, an insert may be coupled to a shell without tabs or slots. An insert may include pins, flanges, arms, or beams that connect to one half or both halves of a shell. For example, an insert may include a pin or pins that plug into holes in one shell half In certain embodiments, an insert, form or divider may be permanently or semi-permanently attached to an outer shell. An inner form connected by a hinge to an outer shell is shown, for example, in U.S. Pat. No. 6,742,683 to Phan.

Figure 4:
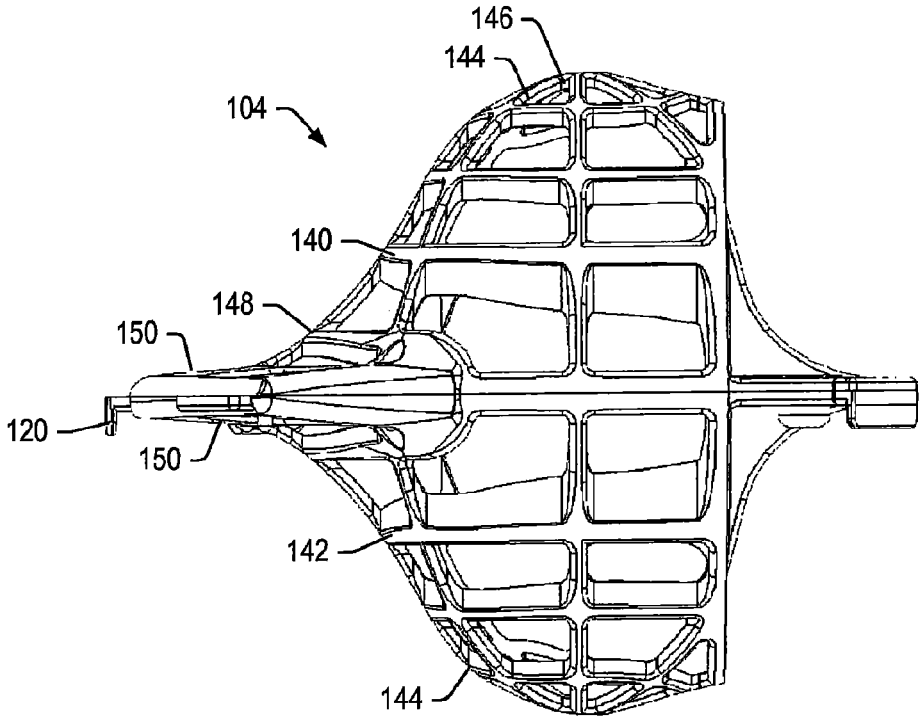
FIG. 4 is a side view of an insert for a padded bra according to one embodiment.

FIG. 4 illustrates insert 104 when separated from shell 102. Insert 104 includes upper insert half 140 and lower insert half 142. Each insert half includes form 144. Each of forms 144 may provide a contoured surface to hold a cup of a bra. Forms 144 may have a contour similar to the inner sides of the breast cup sides they are to be used with. Forms 144 may help preserve the curvature of underwires and bra cups. Forms 144 of upper insert half 140 and lower insert half 142 may be mirror images of one another, or they may be different. Forms 144 may include rounded portion 146, curved portion 148, and flat portion 150. Curved portion 148 may be in the form of a fillet that provides a smooth transition between rounded portion 146 and flat portion 150. The shape of curved portion 148 (e.g., concave) may allow for space to accommodate padding of a padded bra cup. Forms may have various shapes, such as spherical, s-shaped, slanted, flat, ovate, or irregular. Forms may be integral to an insert, or they may be a separate element (e.g., attached to an insert base).

When installed in shell 102, insert 104 may serve to divide internal volume 154 of shell 102 into two halves. Referring to FIG. 2B, passages 158 extend between the two halves. Insert 104 includes pocket 160. Pocket 160 includes opening 162. Pocket 160 may house one or more bra straps (e.g., when a bra cup of the bra is placed on each of forms 144). Pocket 160 can also house delicate accessories, such as removable bra straps, demi-pads, pushup pads, shoulder pads, hosiery, panties, and scarves. Passages 158 may accommodate an intercup bridge of a bra. In one embodiment, passages may accommodate up to three bra intercup bridges, depending upon the thickness of the bra's cups.

In one embodiment, shell 102 has sufficient space to accommodate one thickly-padded bra, or two stacked semi-padded bras, or three stacked non-padded bras. When more than one bra is placed inside the protector, they may be stacked so that the front sides of the cups of the second bra faces the breast sides of the cups of the first bra, etc.

In an embodiment, a system for washing garments includes a shell and two or more inserts. Each insert may be interchangeably installed in the shell. The inserts may have different shapes. Each of the shapes may accommodate a different type or shape of garment. For example, one insert may have a form suitable for washing a padded bra and another insert may have a form suitable for washing unpadded bras. A user of the device may select the appropriate insert or inserts for the garment or garments the user desires to wash, dry, or store.

Figure 5:
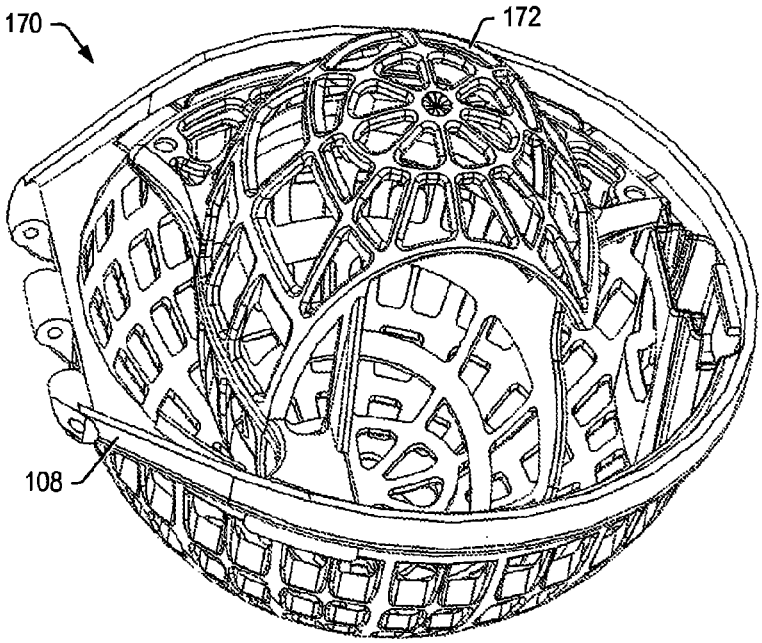
FIG. 5 illustrates a device suitable for washing an unpadded bra according to one embodiment.

FIG. 5 illustrates a washing device for an unpadded bra according to one embodiment. Device 170 includes insert 172. The shell of the device shown in FIG. 5 may be the same as that described above with respect to FIGS. 1, 2A, and 2B (for clarity, only lower shell half 108 is shown in FIG. 5). Insert 172 may couple with lower shell half 108 in the same manner as insert 104 (shown, for example, in FIGS. 2A and 3).

Figure 6:
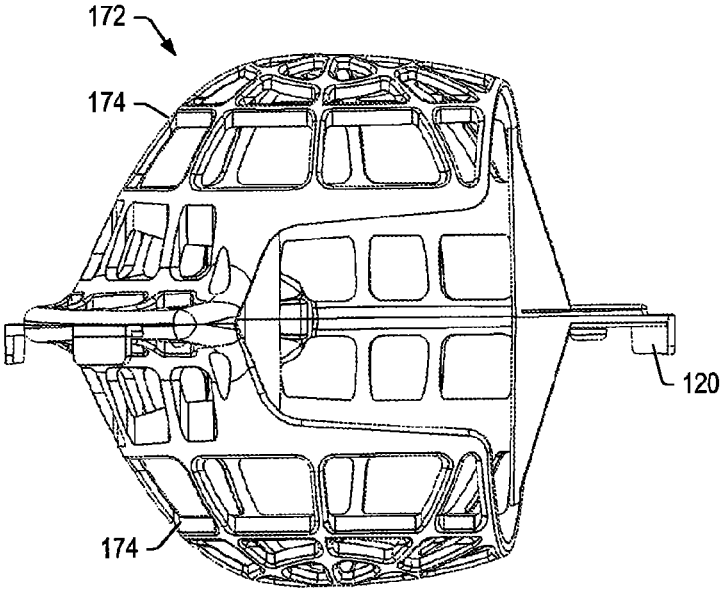
FIG. 6 is a side view of an insert suitable for washing an unpadded bra according to one embodiment.

FIG. 6 is a side view that illustrates insert 172 when not installed in shell 102. Insert 172 includes forms 174. Forms 174 may have more fully rounded shape than that of forms 144 of insert 104. More rounded forms may be better suited for holding a bra cup of an unpadded bra.

Figure 7:
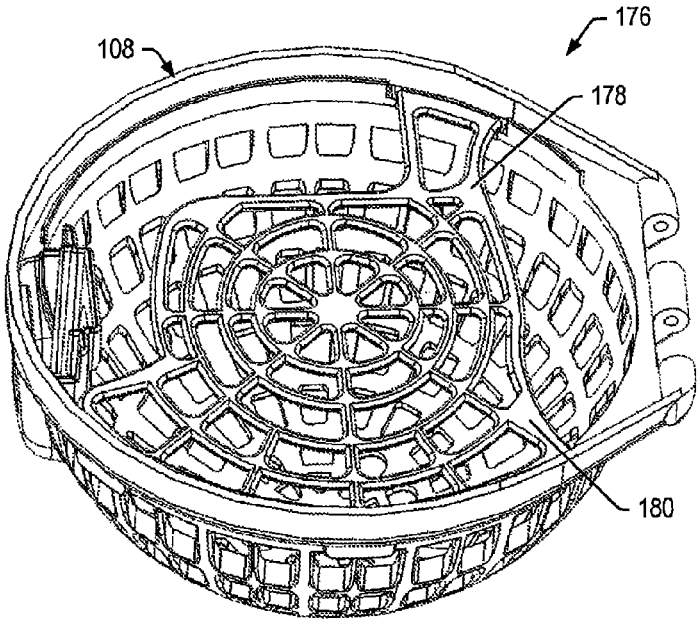
FIG. 7 illustrates a device suitable for washing a bra having prosthesis according to one embodiment.

In some embodiments, a washing device may include a form suitable for washing a garment that holds one or prosthetic devices (e.g., a post-mastectomy bra). FIG. 7 illustrates a washing device for a bra having a prosthetic device according to one embodiment. Device 176 includes insert 178. The shell of the device shown in FIG. 7 may be the same as that described above with respect to FIGS. 1, 2A, and 2B (for clarity, only lower shell half 108 is shown in FIG. 7). Insert 178 may couple with lower shell half 108 in the same manner as insert 104.

Figure 8:
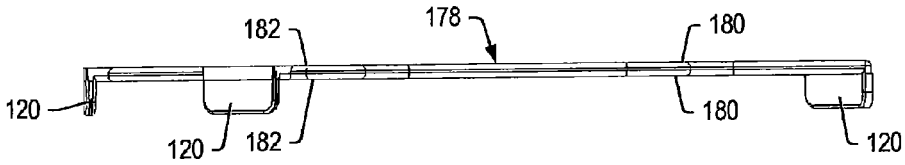
FIG. 8 is a side view of an insert suitable for washing a bra having prosthesis according to one embodiment.

FIG. 8 is a side view that illustrates insert 178 when not installed in shell 102. Insert 178 includes forms 180. Forms 180 may include flat surfaces 182. Flat surfaces may accommodate a bra cup that carries a breast prosthesis. Forms for garment carrying a prosthesis may also be a convex, concave, or other suitable shape. In one embodiment, a form for a garment carrying a prosthesis is customized for the garment. Washing devices (e.g., device 176) can also be used for washing, drying, or storing removable bra straps, demi-pads, pushup pads, shoulder pads, hosiery, panties, scarves and small clothing articles. Alternatively, such items may be washed in shell 102 without any insert.

In some embodiments, the opposing sides of an insert may have different shapes. For example, an insert may include a rounded surface on one side (e.g., for an unpadded bra cup) and a flat surface on the other side (e.g., for a bra cup with a breast prosthesis).

Because inserts 104, 172, and 178 can each be inserted into a same shell (e.g., shell 102), a common shell can be used for washing different types of bras. Although only three inserts are shown in FIGS. 2A-8, a system may include less than three different inserts or more than three different inserts. Inserts may be provided for garments other than bras. For example, inserts may be provided for items such as hats, gloves, scarves, hosiery, or slippers.

Insert 104, upper shell half 106, and lower shell half 108 may be foraminous, e.g., they may have numerous holes. These holes may allow water, detergent, and air to freely penetrate to a bra inside (not shown) for thorough cleaning, drying, and storage. The numerous holes may allow detergent, water, and air to freely and thoroughly penetrate and flow between the bras when a garment or garments (e.g., two semi-padded or three non-padded bras are washed in the device. In one embodiment, the diameter of each hole is about one cm. In one embodiment, the holes are between about 0.5 cm and about 1.0 cm. The holes may be smaller than the bra's shoulder straps, which will prevent the straps from falling out of the holes. Small holes may also prevent bra's back straps and shoulder straps from losing elasticity and the hooks on the bra's back strap from catching onto other clothing articles, zippers, buttonholes, the washer and dryer's crevices, as well as the bra itself. In one embodiment, shell 102 has a diameter of about 12 to about 16 cm with each half having about 60 to 80 holes (depending upon the device's size, which is determined by the bra's cup size). Insert 104 may have about 40 to 70 holes. In some embodiments, a flange, web or other portion of an insert connecting a form may include openings. For example, as shown in FIG. 2A, insert 104 includes holes in the area of flat portion 150.

Figure 9:
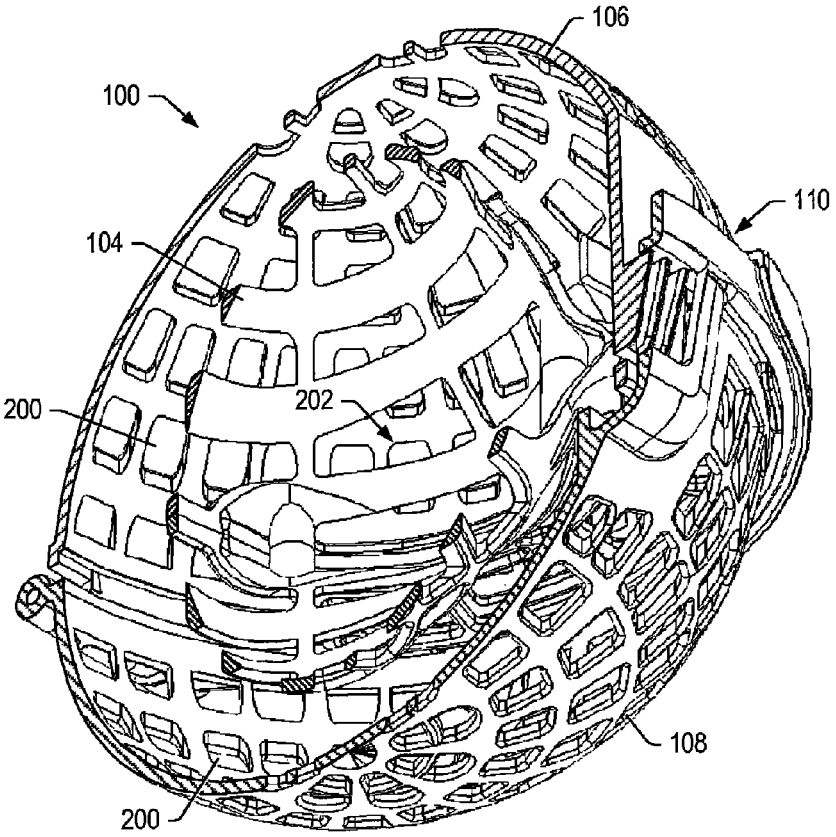
FIG. 9 is a cross-sectional view of a washing device with a shell and an insert according to one embodiment.

FIG. 9 illustrates a cross sectional view of a washing device according to one embodiment. Upper shell half 106 and lower shell half 108 include shell openings 200. Insert 104 includes insert openings 202. In some embodiments, shell openings 202 are sized and shaped to inhibit the bra strap or portions thereof from extending outside of the shell. Holes may be large enough for water, detergent, and air to penetrate, but small enough to contain bra shoulder strap, back strap, and hooks, thus preventing them from becoming tangled with other clothing articles and the washer and dryer's crevices. Insert openings 202 may be larger than shell openings 200. Relatively large insert openings 202 may allow for better flow through the insert, thereby increasing cleaning effectiveness. Apertures (such as openings 200 or openings 202) in a washing device may be various shapes, including round, rectangular, square, trapezoidal, hexagonal, triangular, ovate, or irregular.

Figure 10:
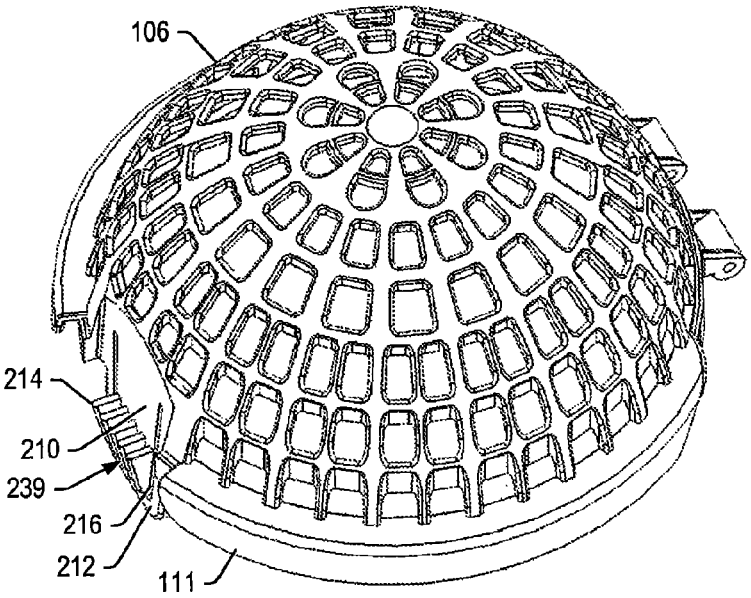
FIG. 10 illustrates an upper shell half of a device including a latch mechanism according to one embodiment.

FIGS. 10-13 illustrate latch mechanism 110. Referring to FIG. 10, upper shell half 106 includes tongue 210 and loop 212. Tongue 210 includes latch projections 214. Tongue 210 may resiliently deflect when a load is applied to latch projections 214 toward the interior of upper shell half 106. U-shaped slot 216 may extend through the entire thickness of upper shell half 106, thereby creating a U-shaped gap between tongue 210 and loop 212.

Figure 11:
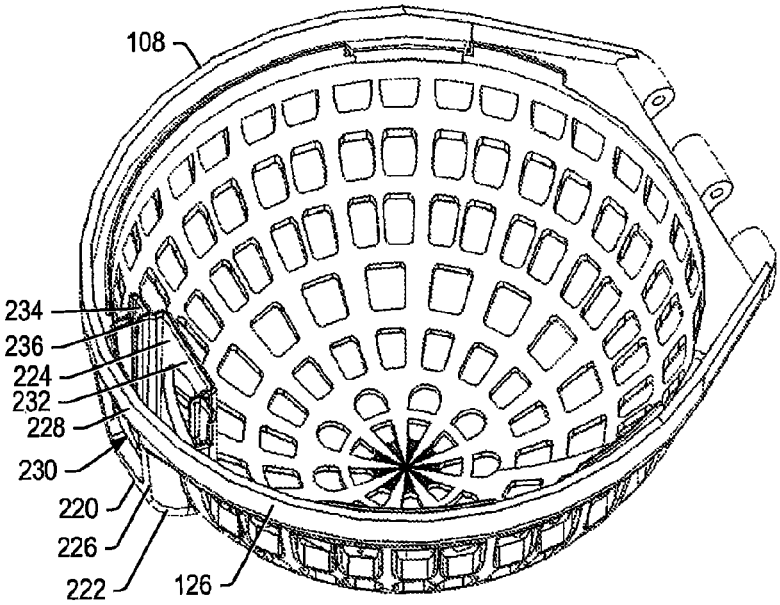
FIG. 11 illustrates a lower shell half of a device including a latch mechanism according to one embodiment.

Referring to FIG. 11, lower shell half 108 includes receptacle 220. Receptacle 220 includes exterior portion 222 and interior portion 224. Exterior portion 222 includes raised front wall surface 226, catch 228, and finger opening 230. Interior portion 224 includes back wall 232, sides 234, and rails 236. Raised front wall surface 226 and catch 228 may shield tongue 210 from normal wear and tear. In addition, having tongue 210 recessed may help keep device 100 from being accidentally opening during washing, drying, and storage.

Figure 12:
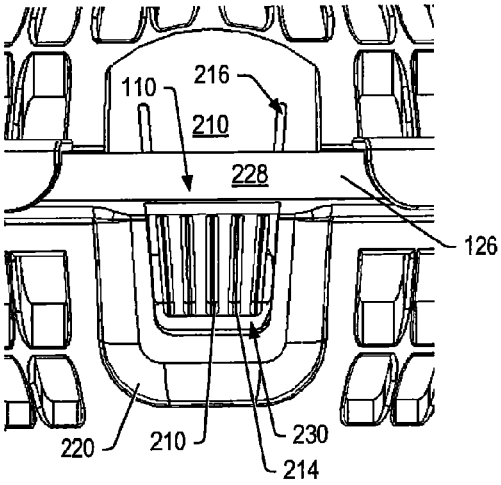
FIG. 12 illustrates a latch mechanism for a washing device according to one embodiment.
Figure 13:
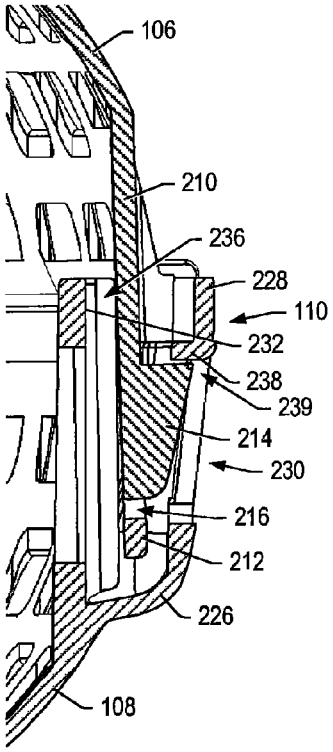
FIG. 13 is a cross section view of a latch mechanism for a washing device according to one embodiment.

FIG. 12 illustrates latch 110 in a latched position. FIG. 13 illustrates a cross-sectional view of latch 110 in a latched position. As shown in FIG. 13, catch 228 includes catch tab 238. During operation of latch mechanism 110, tongue 210 and loop 212 are received in receptacle 220. Latch projections 214 slide over catch tab 238. The distal portion of tongue 210 deflects inwardly as tongue 210 and loop 212 advance into receptacle 220. When latch projections 214 slide beyond catch tab 238, tongue 210 may spring back outwardly such that latch projections 214 extend into finger opening 230. Tongue 210 may snap into a latched position. Contact between latch projections 214 and catch 228 inhibit shell 102 from opening.

To open shell 102, a user may engage the upper edge of outer rim 126 with one or more fingers and depress tongue 210 with the thumb of the same hand. The user may push inwardly on latch projections 214 of tongue 210 through finger opening 230 until tongue 210 bottoms out on back wall 232. When tongue 210 bottoms out on back wall 232, a portion of latch projections 214 (e.g., tips 239) may come just short of clearing catch tab 238. The user may exert an upward force on tongue 210 so as to overcome the resistance of latch projections 214 against catch tab 238 and force latch projections 214 upward past catch tab 238. The inner end of catch tab 238 and/or back wall 232 may deflect at least slightly under the upward force of latch projections 214 so as to allow latch projections 214 to pass catch tab 238. Thus, a user releases latch mechanism 110 by simultaneously applying force in two directions (e.g., a force inward on tongue 210 against the resilient force of the tongue, and a force upward on tongue 210 against the resistance of catch tab 238). A latch mechanism that opens by the application of a force in two directions may be less prone to accidental opening during use in a washing machine. For example, in the embodiment described above, even if latch projections 214 directly strike a pointed surface (e.g., part of the agitator of the washing machine) when the device is agitated within the washing machine (thereby applying an inward force to tongue 210), latch mechanism 110 may remain latched because there is no upward force to impel latch projections 214 over catch tab 238.

As noted above with respect to FIG. 11, interior portion 224 of receptacle 220 includes rails 236. Loop 212 on upper shell half 106 may contact rails 236 when tongue 210 and loop 212 are inserted into receptacle 220. Contact between loop 212 and rails 236 may inhibit the upper portion of tongue 210 from deflecting inwardly. In some embodiments, contact between loop 212 and rails 236 may inhibit latch mechanism 110 from opening accidentally during washing.

In certain embodiments, a tongue may be relatively short such that a relatively large force is required to deflect the end of the tongue. For example, in one embodiment, slots of loop 216 (shown in FIG. 12) do not extend above the top of inner rim 112 (i.e., would not be visible in FIG. 12) when shell 102 is closed.

Figure 14:
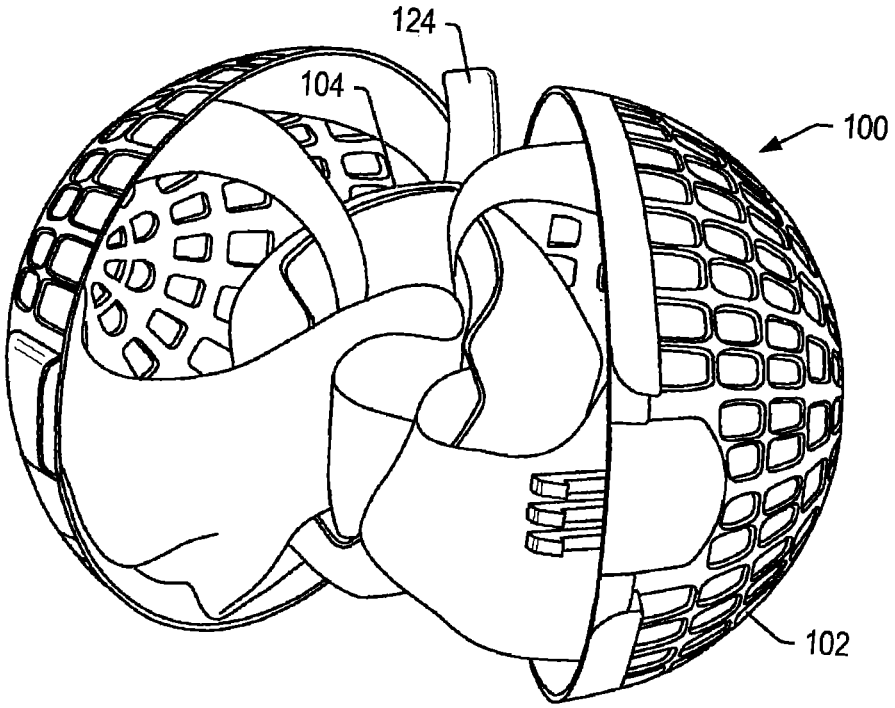
FIG. 14 illustrates a partially exploded view of a washing device with a bra according to one embodiment.

FIG. 14 illustrates placement of a bra in a washing device according to one embodiment. As noted above, insert 104 can be removed from shell 102. When insert 104 is removed, one or more bras can be stacked inside the shell. When washing, drying, or storing one bra in the device, the bra may be placed with its bra cup's front sides facing the interior surfaces of shell 102. If a second bra is placed into the device, the second bra's front sides face the first bra's breast sides. In certain embodiments, a third bra may be placed within the device. The third bra's cup front sides face the second bra's breast sides. After all bras are positioned in shell 102, insert 104 may be installed on lower shell half 108. Shoulder straps and back straps of both the first and second bras are tucked into pocket 160. Shell 102 may be closed. In an alternate method, a garment may first be arranged on or in an insert, and then the insert installed (with garment) into the shell.

Multiple bras can be thoroughly cleaned, dried, and stored. When two semi-padded or three non-padded bras are simultaneously washed in the device, holes may allow detergent, water, and air to freely penetrate and flow between the bras to thoroughly wash and dry as well as safely store each bra, including a middle placed bra when three bras are concurrently washed.

Figure 15:
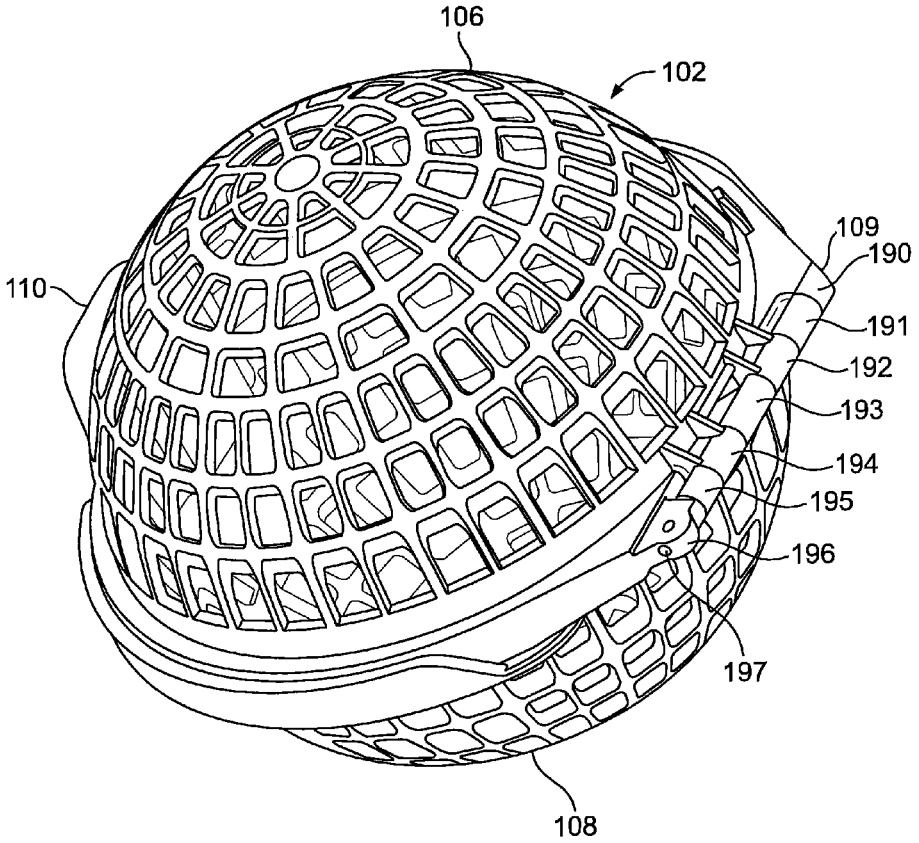
FIG. 15 is a perspective view of a washing device which illustrates one embodiment of a hinge arrangement for the upper and lower shell portions.

In an embodiment, FIG. 15 illustrates an example of the hinge 109 for the shell 102 in greater detail. Hinge 109 is generally disposed on a side of the shell 102 which is approximately opposite from the latch mechanism 110, and hinge 109 permits opening of the upper and lower shell portions 106, 108 when the latch is released. Hinge 109 consists of a plurality of knuckles 190-196 which extend outwardly from the rims of the upper and lower shell portions 106, 108. For example, knuckles 190, 192, 194 and 196, which extend outwardly from the upper shell portion 106, are spaced apart such that knuckles 191, 193, 195 which extend outwardly from the lower shell portion 108 fit between the spaced apart knuckles 190, 192, 194 and 196, such as in an alternating sequence or arrangement.

When all of the knuckles 190-196 are fitted together and arranged as shown in FIG. 15, the knuckles are in axial alignment, such that an internal bore or cylindrical hole 197 extends through knuckles 191-196 and partially into knuckle 190. That is, preferably the internal bore 197 does not extend entirely through knuckle 190. Otherwise, a hinge pin 198 (FIG. 16A), which is inserted during assembly of the washing device into the bore 197 at knuckle 196, could be susceptible of migrating out of either knuckle 196 or knuckle 190. For example, hinge pin 198 may be about 0.093 inches (0.24 cm) in diameter.

Figure 16A:
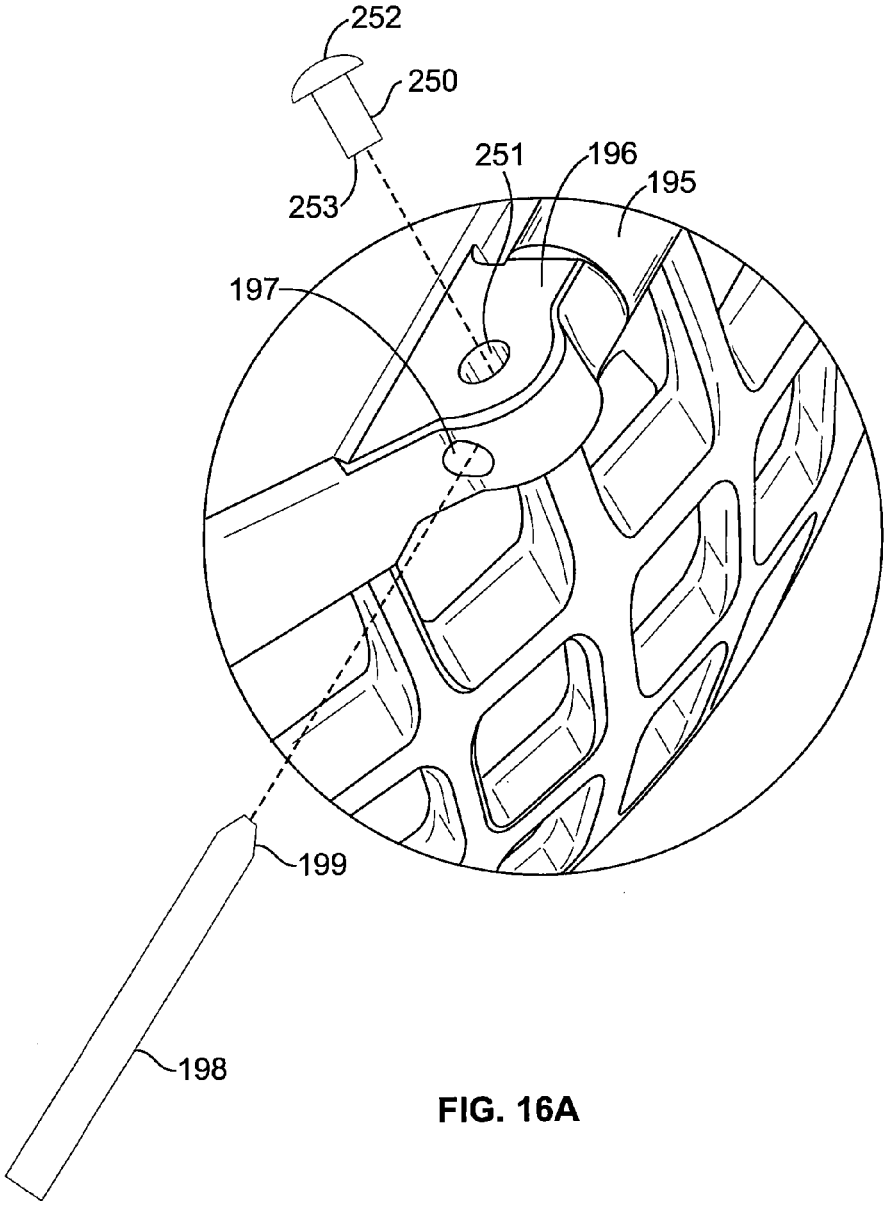
FIGS. 16A and 16B are enlarged views of one end of the hinge arrangement illustrated in FIG. 15.
Figure 16B:
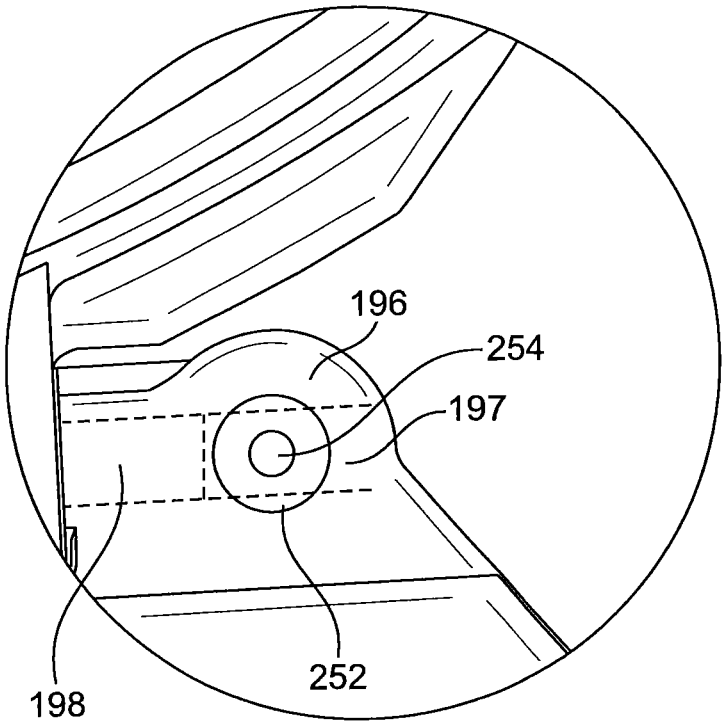

FIGS. 16A and 16B are enlarged views of one end of the hinge 109 shown in FIG. 15; particularly that portion of hinge 109 which consists of knuckle 196. In the partially exploded view of FIG. 16A, the hinge pin 198, may have a tapered end 199 to facilitate insertion of the hinge pin into the internal bore 197 at knuckle 196 of hinge 190. A hole or aperture 251 disposed in knuckle 196 intersects partially or fully with bore 197. As shown in FIG. 16A, hole 251 is disposed perpendicularly to bore 197. When the hinge pin 198 is fully inserted into bore 197, the near end of hinge pin 198 does not block hole 251 (FIG. 16B), such that a fastener, such as a rivet or an eyelet 250, or such as a screw or the like, may be inserted into hole 251 to block hinge pin 198 from migrating out of the bore 197 at knuckle 196.

As seen in FIG. 16B, eyelet 250 has a flared or capped end 252 which comes to rest on one side of knuckle 196 when it is inserted into hole 251. Eyelet 250 is of sufficient length that the other end 253 of eyelet 250 protrudes from hole 251. End 253 may be then flared, such as by a conventional riveting process. Eyelet 250 is then secured in hole 251 by the capped end 252 resting against one side of knuckle 196 and by flared end 253 resting against the opposite side of knuckle 196. Eyelet 250 may be partially or entirely hollow. In the example shown in FIG. 16B, a cylindrical hole 254 extends entirely through eyelet 250.

Preferably, eyelet 250 is of a soft non-rusting metal, such as aluminum, such that the flaring of end 253 of the eyelet can be accomplished without damage to the plastic material of knuckle 196. Thus, hinge pin 198 is prevented from migrating out of bore 197 by eyelet 250 which blocks the bore 197.

As used herein, "shell" includes any element that at least partially encloses, houses, or covers one or more other objects. Examples of such objects include garments, dividers, forms, inserts, and accessories. A shell can be any of various shapes, including spherical, cubic, egg-shaped, rectangular, clam-shaped or irregular. A shell can have one part or more than one part. For example, a shell may have two halves that are connected by a hinge. A shell may have closed or open surfaces (e.g., surfaces having openings).

As used herein, "location" refers to a location of something in space. A location may be a three-dimensional area, zone, or region. For example, a location may be the internal volume on one side of a shell of a bra-washing device. The volume may be bounded, for example, by the inner surfaces of a shell. As used herein, "in a location" includes a specific location (e.g., in direct contact with an insert) or a general location (e.g., anywhere within a desired half of the volume of a spherical shell).

As used herein, "divider" includes any element that at least partially divides a volume into two or more portions. For example, a divider may divide the inner volume of a shell into two equal hemispheres. A divider may divide a space into equal portions or unequal portions.

As used herein, "garment-washing water" means a solution or mixture that includes water and soap, detergent, or other composition(s) for cleaning garments.

Further modifications and alternative embodiments of various aspects of the invention may be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims. Terms relating to orientation, such as "upper", "lower", "top", "bottom", "left", or "right", are used for reference only; the device herein may be used in any orientation.

While particular embodiments of the invention have been shown and described, it will be obvious to those skilled in the art that changes and modifications may be made therein without departing from the invention in its broader aspects.

The invention claimed is:

1. A bra-washing device, comprising:

a shell having an interior;

the shell including two shell portions, each shell portion having a rim;

a latch which holds the two shell portions closed when the latch is closed and which may be opened by releasing the latch to access the interior of the shell;

a hinge which pivotally couples the two shell portions to each other, the hinge comprising:

at least one hinge knuckle extending from the rim of each shell portion, wherein the hinge knuckles of the two shell portions have internal bores that are configured to be in axial alignment extending into the hinge knuckles on each shell portion, an end projection on one of the shell portions, the end projection located axially outward of the hinge knuckles, the end projection has an end projection internal bore that has open ends, the end projection internal bore configured to be in axial alignment with the internal bores of the hinge knuckles to form a hinge internal bore, the end projection has an aperture that intersects the end projection internal bore at a location axially inward of the outer open end of the end projection internal bore and wherein the aperture is not in axial alignment with the internal bores of the hinge knuckles, a hinge pin having an end, the hinge pin inserted through the outer open end of the end projection internal bore and into the internal bores of the hinge knuckles such that the hinge pin is disposed entirely within the hinge internal bore and not axially outward of the aperture, said hinge pin is configured to migrate axially outward of the outer open end of the end projection internal bore unless restrained, and a fastener is inserted into the aperture of the end projection to keep the hinge pin from migrating beyond the fastener and out of the hinge internal bore and wherein the fastener contacts both sides of the end projection internal bore.

2. The bra-washing device of claim 1, said fastener entirely blocking the internal bore to prevent the hinge pin from sliding out of the bore.

3. The bra-washing device of claim 1, said fastener comprising an eyelet.

4. The bra-washing device of claim 1, said fastener comprising a rivet.

5. The bra-washing device of claim 1 wherein the internal bore extends only partially into one of the hinge knuckles at one side of the hinge.

6. The bra-washing device of claim 1, said hinge pin having a tapered end to facilitate insertion of the hinge pin into the internal bore.

7. The bra-washing device of claim 1, further comprising: a plurality of apertures disposed in said shell, said plurality of apertures sized to inhibit a bra strap from extending through the shell.

8. The bra-washing device of claim 1, further comprising: a divider insertable into the interior of the shell, the divider comprising at least one form for at least a portion of a bra cup.

9. The bra-washing device of claim 8, wherein the divider couples to the rim of one of the shell portions.

10. The bra-washing device of claim 1, wherein the rim of a first shell portion includes a lip, and the rim of a second shell portion includes a channel, the lip on the first shell portion couples into the channel in the second shell portion when the shell is closed.

11. The bra-washing device of claim 1, wherein the aperture of the end projection is disposed substantially perpendicularly to the internal bore of the end projection.

12. The bra-washing device of claim 1, wherein the fastener and the hinge pin are configured whereby the end of the hinge pin engages the fastener to keep the hinge pin from sliding axially and migrating out of the internal bore.

13. The bra-washing device of claim 11, wherein the fastener and the hinge pin are configured whereby the end of the hinge pin engages the fastener to keep the hinge pin from sliding axially and migrating out of the internal bore.

14. The bra-washing device of claim 1, wherein the fastener has a flared end on each side of the aperture of the end projection, and the flared ends secure the fastener in the aperture.

15. The bra-washing device of claim 11, wherein the fastener has a flared end on each side of the aperture of the end projection, and the flared ends secure the fastener in the aperture.

16. The bra-washing device of claim 1, wherein the fastener has a flared end, the end projection has a substantially flat surface area section, and the flared end rests against the substantially flat surface area section of the end projection.

17. The bra-washing device of claim 14, wherein the end projection has a substantially flat surface area section on one side of the end projection and another substantially flat surface area section on an opposite side of the end projection, and one of the flared ends rests against one of the substantially flat surface area sections.

18. The bra-washing device of claim 15, wherein the end projection has a substantially flat surface area section on one side of the end projection and another substantially flat surface area section on an opposite side of the end projection, and one of the flared ends rests against one of the substantially flat surface area sections.

* * * * *